US007278170B2

(12) United States Patent
Anderson

(10) Patent No.: US 7,278,170 B2
(45) Date of Patent: Oct. 9, 2007

(54) GLOVE APPARATUS AND METHOD

(75) Inventor: James Trevor Anderson, Berkeley, CA (US)

(73) Assignee: Jas. D. Easton, Inc., Van Nuys, CA (US)

( * ) Notice: Subject to any disclaimer, the term of this patent is extended or adjusted under 35 U.S.C. 154(b) by 378 days.

(21) Appl. No.: 10/840,310

(22) Filed: May 6, 2004

(65) Prior Publication Data

US 2005/0268366 A1 Dec. 8, 2005

(51) Int. Cl.
*A41D 13/08* (2006.01)

(52) U.S. Cl. ..... 2/19; 2/20; 2/21; 2/159; 2/161.1; 2/161.6; 2/161.8; 2/161.3; 2/160; 2/163

(58) Field of Classification Search ..... 2/19, 2/20, 21, 159, 161.1, 161.8, 161.6, 161.3
See application file for complete search history.

(56) References Cited

U.S. PATENT DOCUMENTS 967,120 A 8/1910 Gamble
2,288,467 A 6/1942 Latina
3,528,107 A 9/1970 Rosenbaum
3,602,915 A * 9/1971 Collins ..... 2/19
3,721,996 A * 3/1973 Nadorf ..... 2/19
4,483,022 A * 11/1984 Aoki ..... 2/19
5,031,239 A * 7/1991 Panichello et al. ..... 2/19
5,075,899 A * 12/1991 Funahashi et al. ..... 2/19
5,214,799 A 6/1993 Fabry
5,253,365 A 10/1993 Clevenhagen
5,285,529 A 2/1994 Arena
5,398,342 A 3/1995 Kinnee et al.
5,425,142 A * 6/1995 Scott ..... 2/19
5,448,775 A 9/1995 Yamada et al.
5,592,688 A 1/1997 LaRonge et al.
5,694,641 A 12/1997 Doi et al.
5,694,642 A 12/1997 Rector et al.
5,720,047 A 2/1998 Spitzer
5,799,327 A 9/1998 Clevenhagen
5,819,312 A 10/1998 Snyder
5,855,022 A 1/1999 Storto
6,182,289 B1 2/2001 Brown
6,199,209 B1 * 3/2001 Aoki ..... 2/19
6,305,022 B1 10/2001 Oomura
6,370,691 B2 4/2002 Park
6,536,046 B1 3/2003 Gilligan
6,766,531 B2 * 7/2004 Sullivano et al. ..... 2/19

* cited by examiner

*Primary Examiner*—Gary L. Welch
*Assistant Examiner*—Alissa J Tompkins
(74) *Attorney, Agent, or Firm*—Holland & Hart

(57) ABSTRACT

A glove apparatus having a front shell for fielding a ball and a back shell joined to the front shell. The front and back shells cooperate to define a finger region, a heel region, and a thumb region. The ball glove provides more comfort and control than previous gloves. The ball glove may also be lighter weight than conventional gloves of comparable size. A traction panel may be formed in the back shell adjacent an index finger hole.

31 Claims, 6 Drawing Sheets

GLOVE APPARATUS AND METHOD

FIELD OF THE INVENTION

The present invention relates to sports equipment, and, more particularly, to a glove apparatus used by a ball player to assist fielding balls.

BACKGROUND OF THE INVENTION

Gloves for baseball and softball (collectively referred to for simplicity as "baseball gloves") are nearly as old as the game of baseball itself. Nevertheless, many improvements have been made to baseball gloves over the years as the game has become faster and more difficult to play due to technological advances in the construction of both baseballs and baseball bats. In addition, the increase in fitness, size, and strength of today's players also makes fielding a baseball more challenging. Therefore, baseball glove technology continues to advance to keep pace with other baseball improvements.

Some of the obvious changes that have occurred over the years in the design of baseball gloves include the differences between gloves used by catchers, first basemen, and gloves worn by the rest of the players. As understood by those skilled in the art, a catcher's glove is much different in shape and purpose than gloves used for any other positions on the field. As the game has further developed, there are specialty gloves for a number of different positions: catcher, first baseman, infield, pitcher, and outfield. However, most baseball gloves (except possibly a catcher's glove) could be used today by the weekend warrior at any position.

One of the developments over the years has been the design of many fielding gloves with an external hole for a player's index finger. Over the years, players discovered that impact force on the hand can be reduced by placing the index finger outside of the glove, rather than in a finger stall. In addition, placing the index finger behind the glove offers some players better control of their gloves. Accordingly, many of today's baseball gloves are specifically designed with a hole in the back to accommodate a player's index finger. However, at a top of the hole designed to accommodate a player's index finger is a binding. The inside knuckle or base of a player's index finger normally lies across the binding, which can be quite uncomfortable. Further, the back of most baseball gloves is usually smooth leather, and does not provide much traction or grip to the index finger. A player's index finger may slip and slide across the back of the typical baseball glove and reduce or eliminate the extra control the player is seeking.

In addition, a constant for ball gloves has always been the thumb loop. All conventional baseball gloves have a thumb loop. Some thumb loops are adjustable and generally the thumb loop is used to place the thumb in the glove in a general orientation instead of just floating around inside of the glove. Yet conventional gloves do not have an independent channel for a thumb. Thumb loops add weight to the glove, and some players find themselves fighting the confines of the loop as they use the glove. Thumb loops are uncomfortable for many players.

Moreover, as mentioned above, today's baseball and softball games are characterized by fast play and high ball speeds. Conventional ball gloves, however, are sometimes heavy. The heavier the glove, the more difficult and time consuming it is to maneuver the glove into the desired fielding position. Some users often have difficulty handling conventional gloves because of their weights. There is a constant demand for lighter and lighter gloves.

The present invention is directed to solving, or at least reducing the effect of, one or more of the problems recited above.

SUMMARY OF THE INVENTION

In one of many possible embodiments, the present invention provides a glove apparatus for use in connection with a ball game, such as baseball or softball. The glove apparatus comprises a front shell for fielding a ball and a back shell substantially joined to the front shell. The front and back shells cooperate to define a finger region, a heel region, and a thumb region. The thumb region includes an independent channel receptive of a thumb, but does not include a thumb loop as do conventional gloves. The glove apparatus according to some embodiments may include a channel in the back shell through which an index finger extends. However, at least a portion of the channel is closed by a pad that includes a plurality of external ridges to provide added comfort and control to a user.

According to some embodiments, the material comprising the back shell of the glove apparatus includes a plurality of vent holes. The plurality of vent or pinholes may be arranged in a pattern or they may be random. The back shell may include 50 or more such holes. The back shell may be made of an aramid-type fiber. According to some embodiments, the back shell comprises an open slot and an exterior patch receptive of a finger such as an index finger, the exterior patch having a plurality of protrusions.

Another aspect of the invention provides a glove apparatus comprising a front panel and a back panel joined to the front panel. Unlike conventional gloves, the back panel comprises a plurality of small apertures or holes that allow the glove to breathe and to reduce the weight of the glove. The plurality of holes may comprise 100 or more holes, and contain no threading. The holes may be pin holes no larger than 0.1 inches in diameter, and they may form a pattern extending substantially across the entire back panel. In addition, the glove may include a hole through which an index finger may be extended to the outside of the glove, and a pad comprising a plurality of external ridges adjacent to the hole for the index finger to bear against. The glove may include an independent thumb stall and no thumb loop, and according to some embodiments, the back panel comprises Kevlar®.

Another aspect of the invention provides a glove apparatus comprising a first panel and a second panel attached to the first panel. The first and second panels define a hand cavity. The second panel includes an index finger hole and an index finger pad adjacent to the index finger hole. The index finger pad includes a plurality of ridges. The index finger hole may comprise a channel partially closed by the index finger pad. The index finger pad may comprise leather and the plurality of ridges may include uniform, spaced bumps. According to some embodiments there are 2-20 bumps, preferably about 9 bumps. The plurality of ridges may all be external.

Another aspect of the invention provides a glove apparatus including a first panel and a second panel joined to the first panel, such that the first and second panels define a pocket. At least a portion of the second panel may comprise an aramid-type material such as Kevlar®. At least part of a webbing may also comprise an aramid or other type of man-made material. This embodiment may also include a plurality of finger stalls, and an independent thumb stall without a thumb loop. The ball glove may include a plurality of vent holes disposed therein. The glove may also include a hole for an index finger to extend outside of the glove and an associated pad comprising a plurality of external ridges adjacent to the hole.

Another aspect of the invention provides a glove apparatus including a front leather panel and a back aramid panel. The front leather panel and back aramid panel are joined together to form a hand cavity, but the hand cavity includes no thumb loop. The back aramid panel may include a Kevlar® portion and a leather portion, a hole for an index finger, and a pad having a plurality of external ridges adjacent to the hole.

Another aspect of the invention provides a method of making a glove apparatus. The method may include providing a front shell, providing a back shell, joining the front shell to the back shell, disposing a hole in the back shell for an index finger, and adding an index finger pad comprising a plurality of external ridges. The method may also include cutting a plurality of pin holes in the back shell, and not adding a thumb loop.

Another aspect of the invention provides a ball catching apparatus comprising a glove, the glove having a hand receiving cavity, an index finger hole, and an index finger patch comprising a plurality of external peaks.

Another aspect of the invention provides a glove apparatus comprising a first panel, a second panel attached to the first panel, the first and second panels defining a hand cavity, an index finger hole through the second panel, and a binding extending only partially around the index finger hole. The index finger hole may comprise a channel, such that the binding traverses up and around the channel, but does not extend thereacross.

The foregoing and other features, utilities and advantages of the invention will be apparent from the following more particular description of preferred embodiments of the invention as illustrated in the accompanying drawings.

BRIEF DESCRIPTION OF THE DRAWINGS

The accompanying drawings illustrate various embodiments of the present invention and are a part of the specification. The illustrated embodiments are merely examples of the present invention and do not limit the scope of the invention.

Throughout the drawings, identical reference numbers designate similar, but not necessarily identical, elements.

DETAILED DESCRIPTION

The present specification describes a glove apparatus and methods of making a glove apparatus that may be lighter and more comfortable than conventional ball gloves. Several or all of the new features of the ball gloves described below may be combined into a single ball glove. However, some ball gloves according to the present invention may include only one of the new features described herein. Although the gloves and methods of making the gloves are shown and described with reference to certain embodiments, the features and principles of the present invention may be applied to any ball glove.

As used in this specification and the appended claims, the term "open hole" means a hole that has nothing in it. For example an "open hole" does not have any lacing or threading extending therethrough. The words "including" and "having," as used in the specification, including the claims, have the same meaning as the word "comprising."

Figure 1:
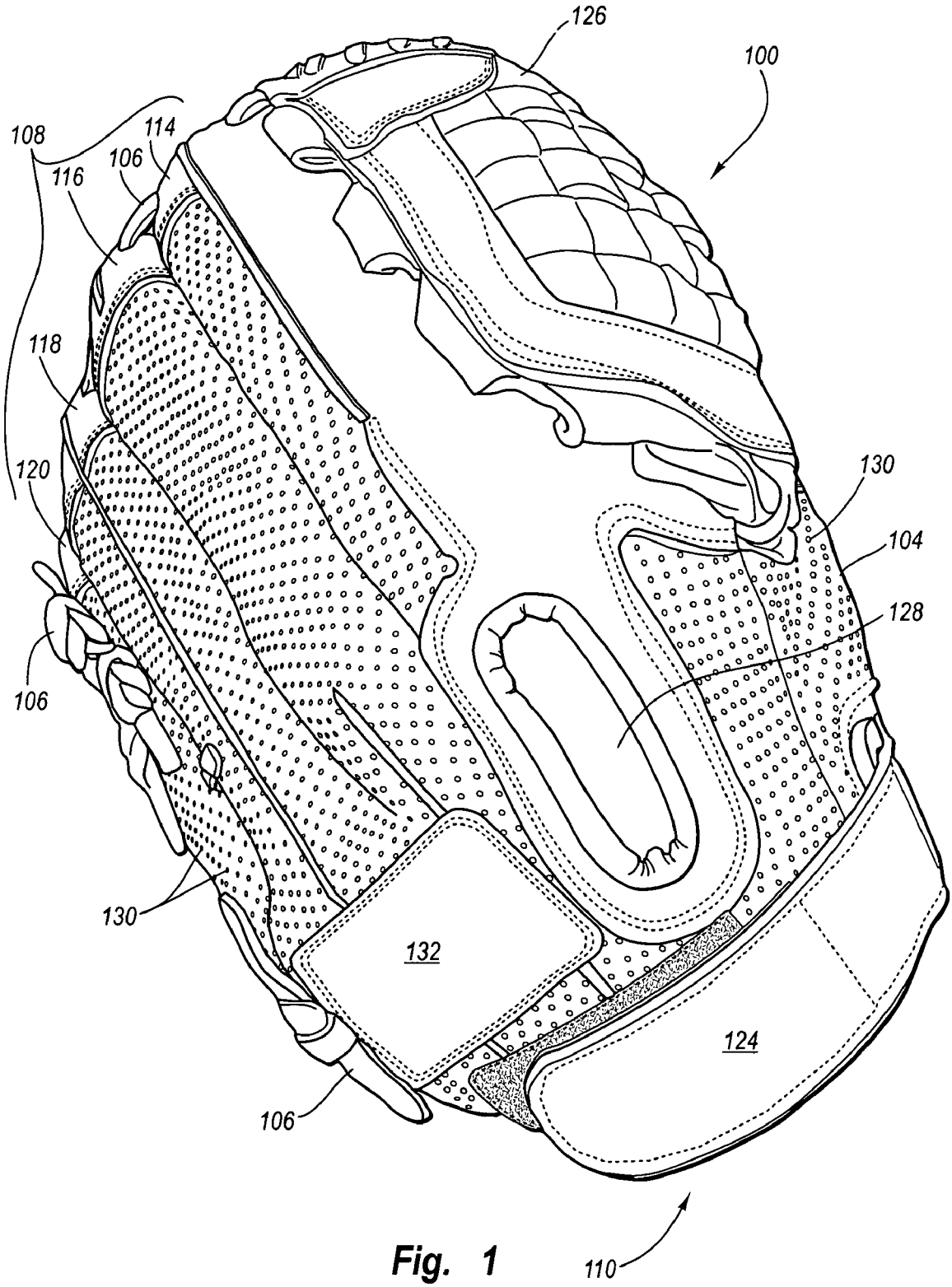
FIG. 1 is a back view of a ball glove having a plurality of holes in a portion thereof according to one embodiment of the present invention.
Figure 2:
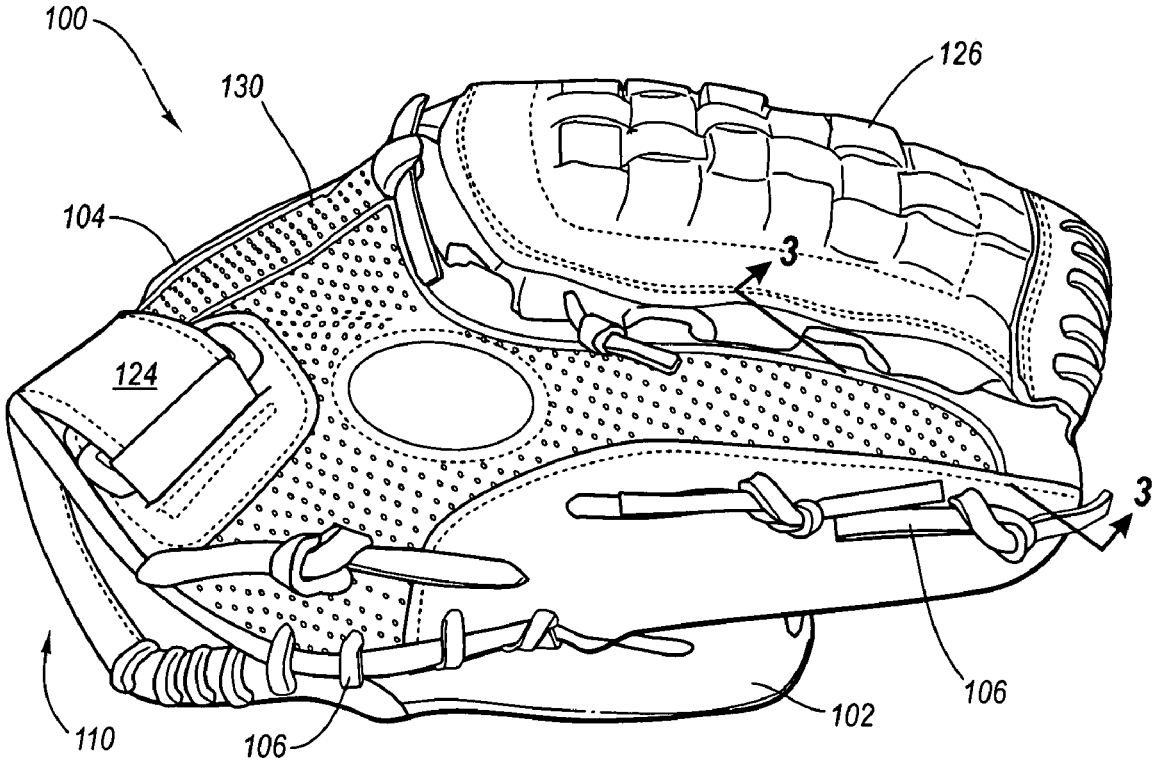
FIG. 2 is a side view of the ball glove of FIG. 1.

Referring now to the drawings, and in particular to FIGS. 1-2, a ball glove 100 according to one embodiment of the present invention is shown. FIG. 1 illustrates the ball glove 100 from a back view, and FIG. 2 illustrates the ball glove 100 from a side view. The ball glove 100 comprises a first or front shell or panel 102 (FIG. 2) and a second or back panel 104. According to the embodiment shown, the front and pack panels 102, 104 comprise leather or other suitable materials. The front panel 102 and the back panel 104 are substantially joined together by a lacing system of one or more laces 106. Lacing of the front panel 102 to the back panel 104 is well known in the art. The laces 106 may extend and tie through a series of eyelets to join the front and back panels 102, 104.

The front and back panels 102, 104 are sized and shaped to cooperate and define a pocket or cavity receptive of a human hand. The pocket or cavity is divided generally into a finger or finger stall region 108 (FIG. 1), a heel region 110, and a thumb region 112 (FIG. 2). As shown in FIG. 1, the finger stall region 108 comprises four individual finger stalls 114, 116, 118, 120 that correspond to the fingers of a user. The thumb region 112 (FIG. 2), however, is generally open. Therefore, according to some embodiments a thumb loop 122 is tied through the back panel 104 to support a user's thumb. Other embodiments, as discussed in more detail below, the glove may be absent of the thumb loop 122. A strap 124 may extend from the back panel 104 to facilitate adjustment of the ball glove 100 to a user's hand. However, some embodiments do not include the adjustment strap 124.

Extending between the thumb portion 112 (FIG. 2) and the first finger stall 114 is a webbing identified generally at 126. The webbing 126 prevents a ball from slipping between the thumb region 112 and the first finger stall 114 during a catch. Any type of webbing may be used with the glove 100. The webbing 126 is preferably hinged between thumb portion 112 and the first finger stall 114 to allow a user to articulate his or her thumb toward his or her fingers and thereby close the glove 100. According to some embodiments, the back panel 104 may include an index finger hole 128 to allow a user to extend an index finger external to the glove 100, rather than into the first finger stall 114.

According to conventional designs, back panels of ball gloves comprise a substantially solid piece of material, with several eyelets to facilitate lacing the back panel to a front panel. However, as discussed above, conventional ball gloves can be relatively heavy and they generally do not breathe. Therefore, according to the embodiment of FIGS. 1-2, the back panel 104 comprises a plurality of open holes or vent holes 130. The vent holes 130 reduce the mass of the back panel 104 and thus the weight of the ball glove 100. In addition, the vent holes 130 advantageously provide an air flow path into and out of the glove 100 to help a user's hand remain cool. It will be understood by the skilled artisan having the benefit of this disclosure that the vent holes 130 may be placed in ball gloves of all types, including ball gloves made of various materials, including man-made materials.

Figure 3:
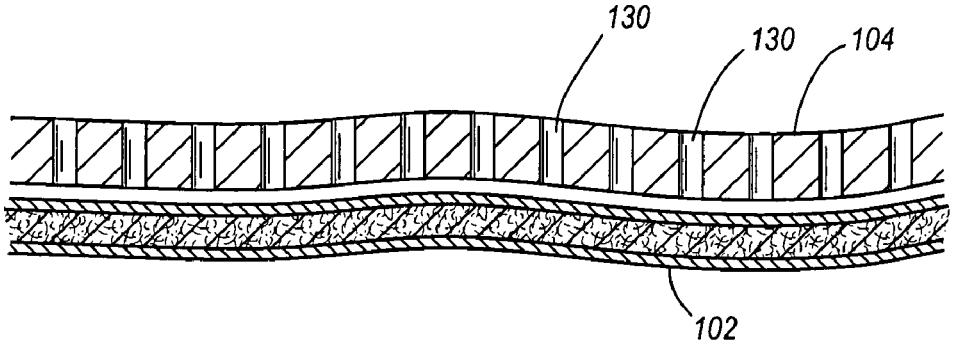
FIG. 3 is a cross section, taken along line 3-3 shown in FIG. 2, of the ball glove of FIG. 1.

FIG. 3 illustrates a cross-sectional view of the ball glove 100 taken along line 3-3 of FIG. 2. As shown in FIG. 3, the vent holes 130 extend through the back panel and have no lacing or threading extending therethrough. The vent holes 130 are preferably arranged in spaced, uniform pattern as shown in FIGS. 1-2. However, non-uniform or random patterns may be used as well. According to some embodiments, there are at least 50 vent holes disposed in the back panel 104. However, there may be many more than 50 vent holes, for example the 100, 200, 500, or even 1000 vent holes or more similar to what is shown in FIGS. 1-2. The vent holes may comprise pin holes according to some embodiments, each with a diameter of 0.1 inches or less. Larger diameter vent holes 130 may also be made, although the preferred embodiment of FIGS. 1-3 comprises vent holes 130 of a diameter smaller than eyelet holes that are large enough to allow the passage of laces 106. According to the embodiment of FIGS. 1-3, each of the vent holes 130 comprises an equal diameter, although vent holes 130 of various sizes are contemplated by the present invention. As shown in FIGS. 1-2, the vent holes 130 preferably extend substantially across the entire back panel 104.

According to the embodiment of FIGS. 1-3, the vent holes 130 are only disposed in the back panel 104. Nevertheless, according to some embodiments the front panel 102 may also (or exclusively) contain vent holes 130. The back panel 104 may also comprise a patch 132 attached thereto, which may be embossed or printed, for example, with a trademark or other insignia.

Although the embodiment of FIGS. 1-3 illustrates the index finger hole 128, some embodiments of the present invention may include an additional feature in relation to the index finger hole 128. Many ball players believe extending the index finger outside of the ball glove 100 adds control to fielding balls, and perhaps reduces the incidence of ball-impact injuries. However, generally the back panel 104 comprises a smooth surface, which lends itself to slip and sometimes discomfort. Therefore, according to another embodiment of the present invention shown in FIGS. 4-7, a ball glove 200 may include an external index finger receiver such as an index finger patch or pad 234.

Figure 4:
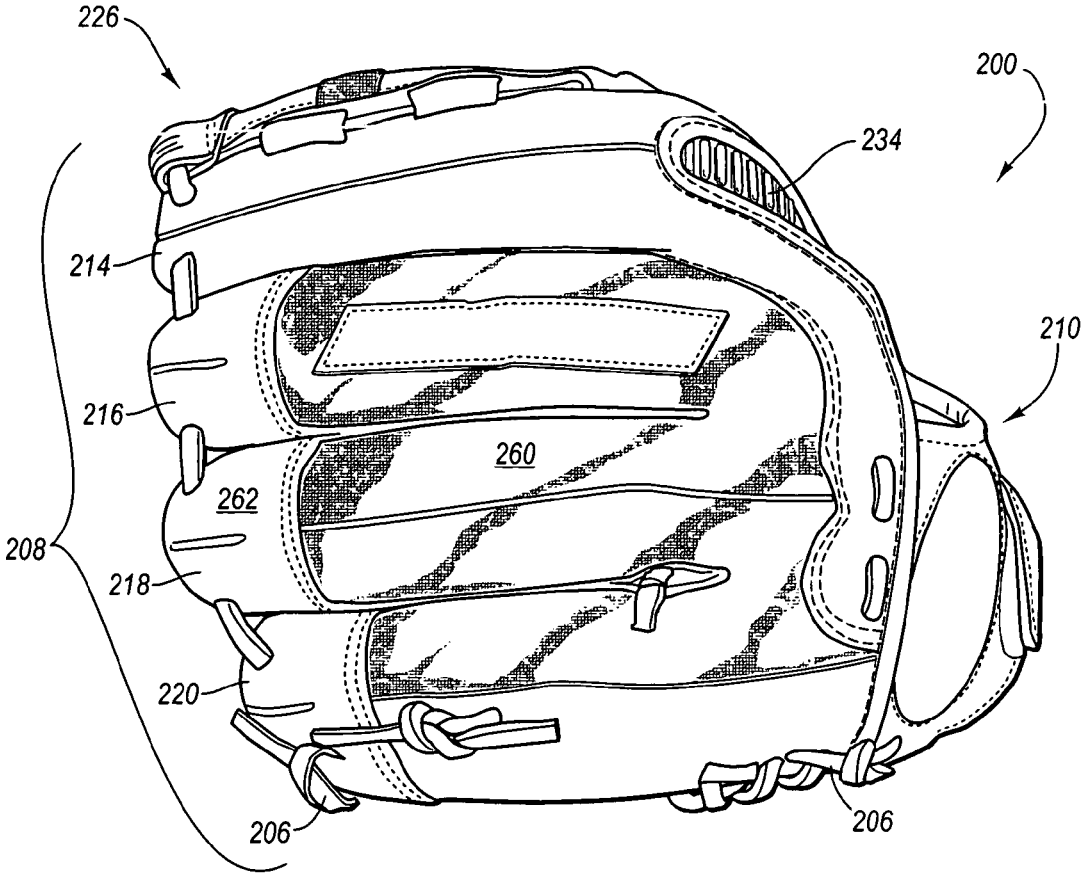
FIG. 4 is back view of a ball glove with a fabric weave and an index finger pad according to one embodiment of the present invention.
Figure 5:
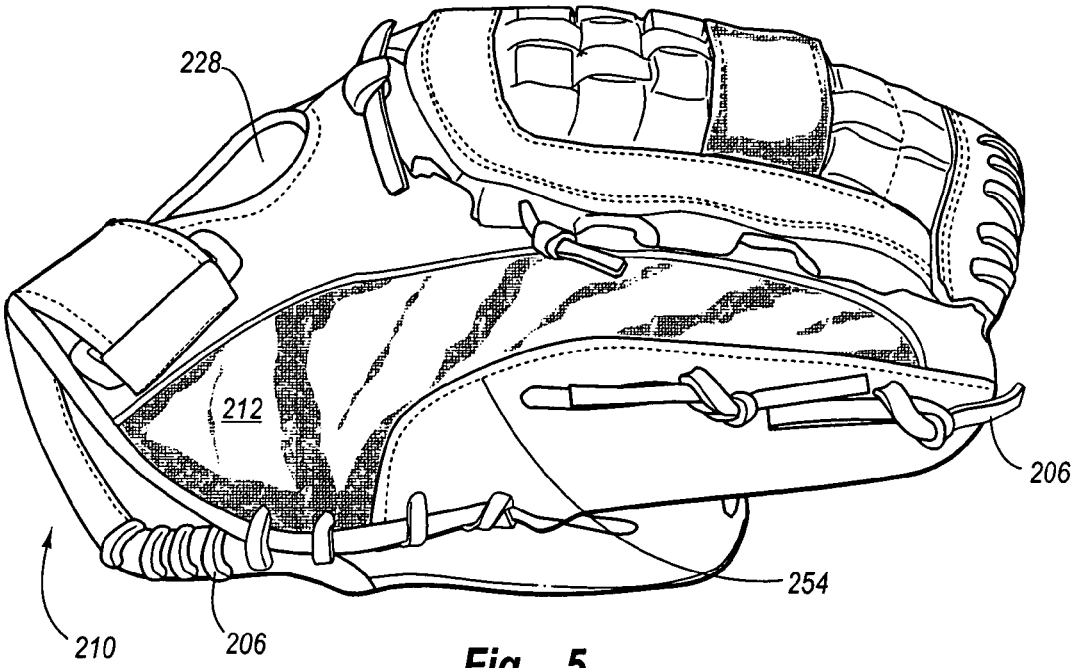
FIG. 5 is a side view of the ball glove of FIG. 4.

According to the embodiment of FIGS. 4-7, the ball glove 200 includes a front shell 202 (FIG. 5) and a back shell 204, and laces 206 joining the front and back shells 202, 204 to define a pocket. The pocket is divided generally into a finger region 208 (FIG. 4), a heel region 210, and a thumb region 212 (FIG. 5). As with the embodiment of FIG. 1, the finger stall region 208 comprises four individual finger stalls 214, 216, 218, 220 corresponding to fingers of a user. The thumb region 212 (FIG. 5), however, is not generally open and is discussed below with reference to FIG. 10. A webbing 226 extends between the thumb portion 212 and the first finger stall 214.

According to principles of the present invention, the glove 200 of FIGS. 4-7 provides the index finger pad 234 to enhance control and comfort to users who prefer to extend a finger external to the glove 200. As shown more clearly in FIGS. 6-7, the glove 200 includes a hole such as an index finger hole 228 that allows a user to position a finger such as an index finger 236 shown in FIG. 7 external to the glove 200 and over the index finger pad 234. However, unlike conventional gloves, a binding 238 does not extend across the hole 228. Instead, the binding 238 traverses up and around the index finger pad 234. Therefore, there is no uncomfortable binding across the hole 228. The index finger pad 234 is arranged adjacent to the index finger hole 228. It will of course be appreciated that other pads for other fingers may also be incorporated into the glove 200 without departing from the principles of the present invention.

Figure 6:
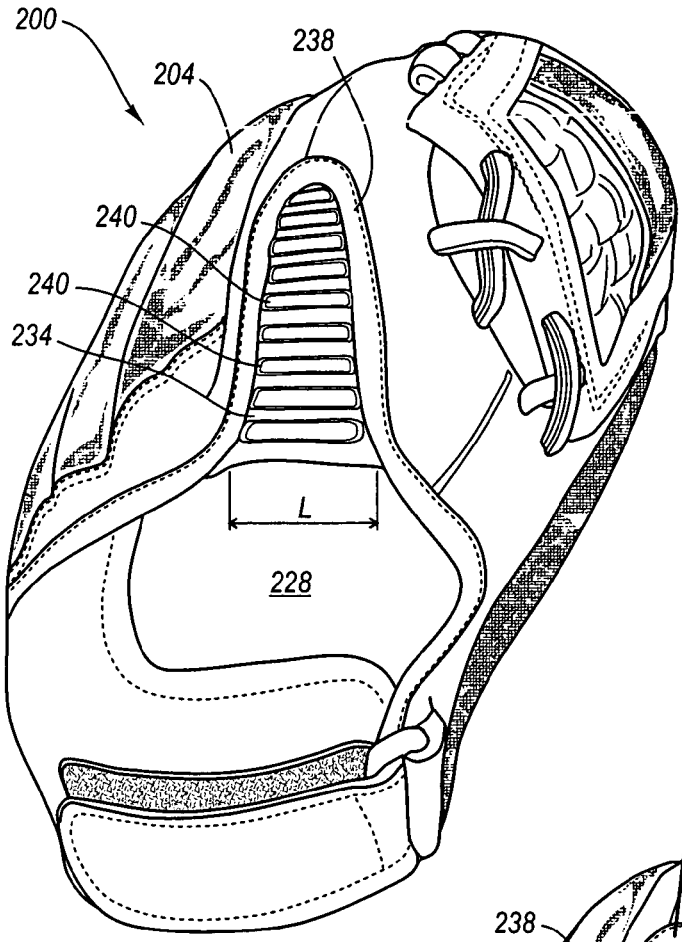
FIG. 6 is a back perspective view of the ball glove of FIG. 4.
Figure 7:
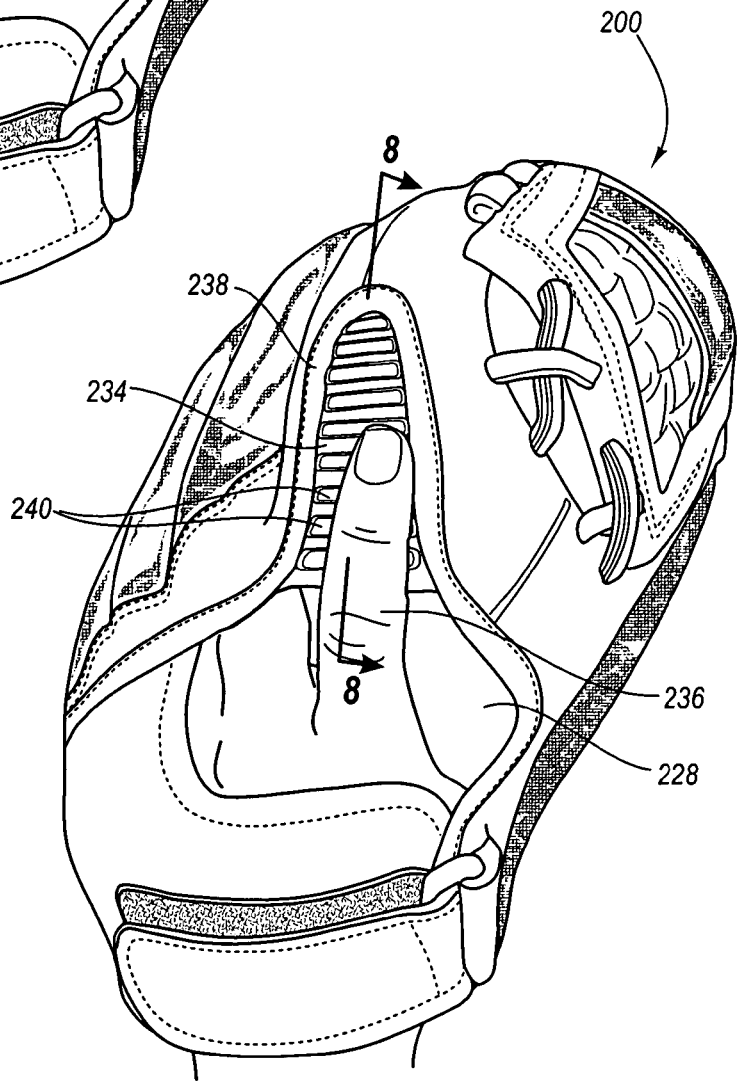
FIG. 7 is a back perspective view of the ball glove of FIG. 4 illustrating a hand within the glove.
Figure 8:
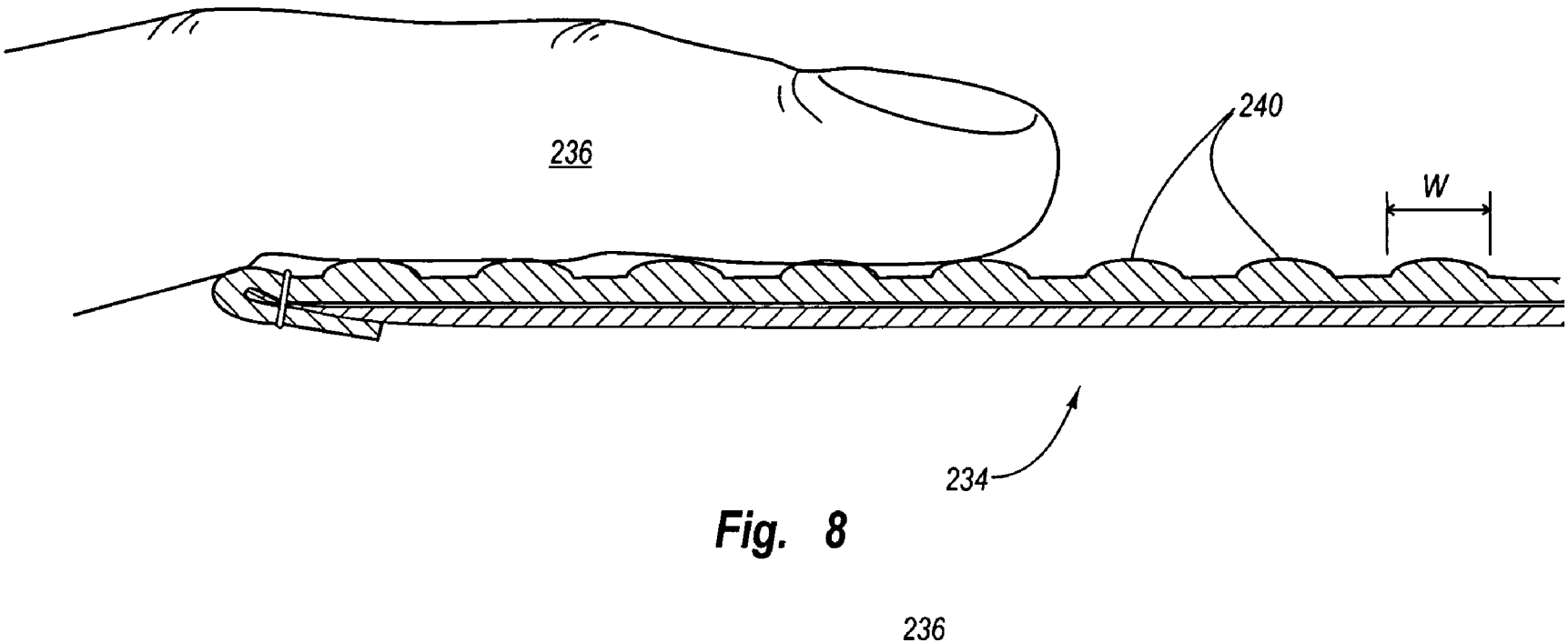
FIG. 8 is a cross section, taken along line 8-8 shown in FIG. 7, of the ball glove of FIG. 4.

As shown in FIGS. 6-7, the back panel 204 comprises a channel defined by the binding 238. The channel is at least partially closed, however, by the index finger pad 234 that extends thereacross. The index finger pad 234 comprises a plurality of ridges, bumps, or protrusions 240 shown in cross-section in FIG. 8, which is a section taken along line 8-8 of FIG. 7. The index finger pad 234 may be made of leather or other material and add comfort and control to the glove 200. The plurality of ridges 240 may only protrude external of the glove 200 as shown in FIG. 8. However, according to some embodiments the index finger pad 234 comprises ridges both externally and internally. The plurality of ridges 240 may range between 2 and 20 ridges or more, preferably between about 5 and 15 ridges. The embodiment of FIGS. 6-7 discloses 9 ridges. According to some embodiments, the ridges 240 are uniform protrusions, substantially evenly spaced from one another. According to the embodiment of FIGS. 6-7, a width W (FIG. 8) of the protrusions is substantially constant, but according to others the width W varies. According to some embodiments, a length L (FIG. 6) of succeeding ridges 240 decreases in a direction from a proximal portion of the pad 234 to a distal portion.

Although the back panel 204 as shown in FIGS. 6-7 comprises a binding channel 238, according to alternative embodiments there is no channel and the index finger pad 234 is added to the back panel 204 as a patch or otherwise.

According to some embodiments of the present invention, the back panel 204 may comprise materials other than leather. For example, according the embodiment of FIGS. 4-5, at least a portion of the back panel 204 comprises a man-made fabric weave. For example, at least a portion of the back panel may comprise an aramid-type material such as Kevlar®. The back panel 204 may thus be of reduced weight without sacrificing strength or comfort. Further, the back panel 204 may have a plurality of holes disposed therein according to some embodiments. According to FIGS. 4-5, the back panel 204 of the glove 200 comprises a Kevlar® portion 260 and a leather portion 262, but according to other embodiments the entire back panel 204 may be made of Kevlar® or other man-made fabric weaves. In addition, other components of the glove 200 may also comprise Kevlar® or other man-made fabric weaves. For example, according to the embodiment of FIGS. 4-5, the webbing 226 also comprises Kevlar® or other man-made fabric weaves.

Figure 9:
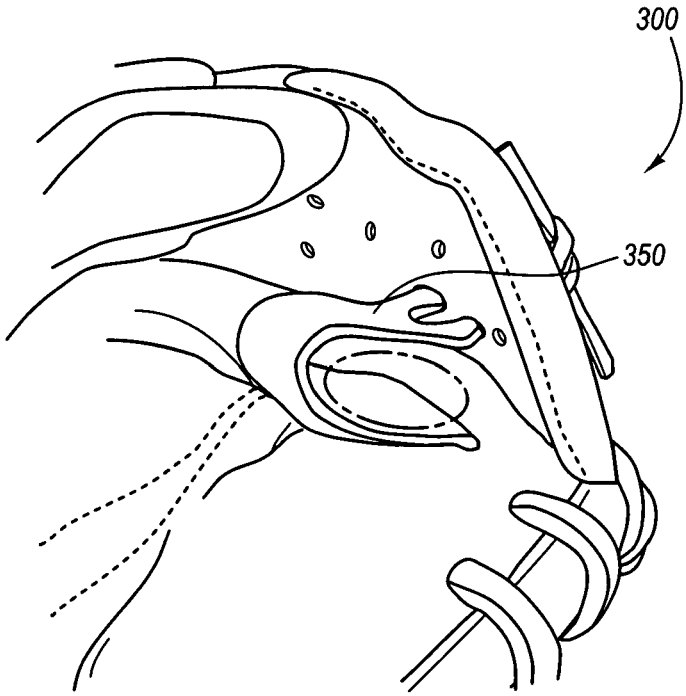
Fig. 9 (Prior Art)
FIG. 9 is an interior view of a hand cavity of a standard baseball glove according to the prior art.
Figure 10:
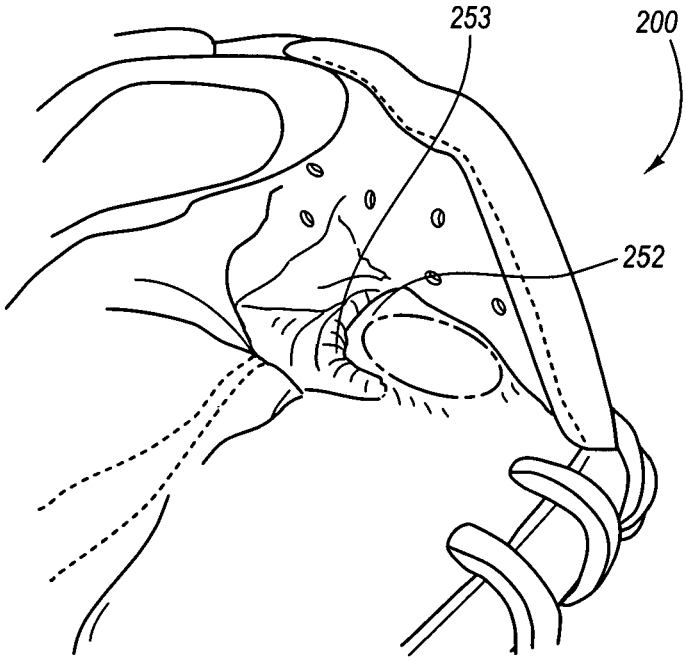
FIG. 10 is an interior view of a hand cavity of the ball glove of FIG. 1 according to one embodiment of the present invention.

As mentioned above, all conventional baseball gloves include a thumb loop 350 such as the one shown in a prior art baseball glove 300 illustrated in FIG. 9. The thumb loop 350 facilitates closing the baseball glove 300, but it is often uncomfortable for many players. Therefore, according some embodiments of the present invention, there is no thumb loop 350. Referring to FIG. 10, an interior view of the ball glove pocket of FIG. 4 is shown. As shown in FIG. 10, there is no thumb loop. However, to facilitate control of the ball glove 200, an independent thumb stall 252 is provided. An interior thumb stall wall 253 defines the independent thumb channel that fits snugly around a user's thumb. The independent thumb stall 252 is similar to the finger stalls 214, 216, 218, 220, and comprises a defined thumb path defined and limited by stitching 254 (FIG. 5) along its perimeter. Conventional gloves allow the thumb portion 212 (FIG. 5) to remain open, such that the thumb of user may float within the thumb portion absent the thumb loop. The present invention provides a defined thumb stall 252 that allows a player the advantages of control without the discomfort a loop.

While the invention has been particularly shown and described with reference to embodiments thereof, it will be understood by those skilled in the art that various other changes in the form and details may be made without departing from the scope of the invention.

What is claimed:

1. A ball glove apparatus, comprising:

a front shell for fielding a ball therein;

a back shell substantially joined to the front shell, the front and back shells cooperating to define a finger region, a heel region, and a thumb region a webbing positioned between the thumb region and the finger region;

wherein the thumb region comprises an interior thumb stall wall defining an independent channel receptive of a thumb and does not include a thumb loop;

wherein the independent thumb channel fits snugly around a user's thumb.

2. A glove apparatus according to claim 1, further comprising a channel in the back shell for an index finger to extend through, wherein at least a portion of the channel is closed by a pad comprising a plurality of external ridges.

3. A glove apparatus according to claim 1 wherein the back shell comprises a plurality of vent holes spaced thereacross.

4. A glove apparatus according to claim 1 wherein the back shell comprises a plurality of pinholes arranged in a pattern.

5. A glove apparatus according to claim 1 wherein the back shell comprises at least 50 holes disposed therein.

6. A glove apparatus according to claim 1 wherein the back shell comprises an aramid fiber.

7. A glove apparatus according to claim 1, further comprising a webbing comprising an aramid fiber.

8. A glove apparatus according to claim 1 wherein the back shell comprises an open slot and an exterior patch, the exterior patch comprising a plurality of protrusions.

9. A method of making a ball glove apparatus, comprising:

providing a front shell;

providing a back shell;

joining the front shell to the back shell;

disposing a hole in the back shell for an index finger providing a webbing positioned between a thumb region and the index finger;

an index finger channel defined by a binding that traverses up and around the index finger channel, but does not extend across the channel;

adding an index finger pad comprising a plurality of external ridges, the index finger pad at least partially closing the index finger channel.

10. A method of making a glove apparatus according to claim 9, further comprising cutting a plurality of pin holes in the back shell.

11. A method of making a glove apparatus according to claim 9, further comprising punching a plurality of vent holes in the back shell.

12. A method of making a glove apparatus according to claim 9, further comprising disposing a pattern of holes in the back shell.

13. A method of making a glove apparatus according to claim 9, further comprising not adding a thumb loop.

14. A ball glove apparatus, comprising:

a first panel;

a second panel attached to the first panel, the first and second panels defining a hand cavity;

an index finger hole through the second panel a webbing positioned between a thumb region and the index finger;

an index finger channel formed adjacent the index finger hole;

a binding extending around the index finger channel, but not extending across the channel.

15. A glove apparatus according to claim 14 wherein the index finger channel is at least partially closed by a separate index finger pad extending thereacross.

16. A ball glove apparatus, comprising:

a first panel;

a second panel joined to the first panel, the first and second panels defining a plurality of finger stalls;

an interior thumb stall wall defining an independent thumb stall a webbing positioned between the thumb stall and the finger stall;

wherein the independent thumb stall is dimensioned to fit snugly around a user's thumb.

17. A glove apparatus of claim 16, wherein the thumb stall does not include a thumb loop.

18. A glove apparatus of claim 17, wherein the thumb stall is dimensioned to fit snugly around the thumb from a base of the thumb to a tip of the thumb.

19. A glove apparatus of claim 16, wherein the thumb stall is dimensioned to substantially prevent longitudinal movement of the thumb within the thumb stall.

20. A glove apparatus of claim 16, wherein the thumb stall is dimensioned to prevent the thumb from touching other parts of a hand while the thumb is within the thumb stall.

21. A glove apparatus of claim 16, wherein an opening of the thumb stall is substantially elliptical in shape.

22. A ball glove apparatus comprising:

a first panel;

a second panel attached to the first panel, the first and second panels defining a hand cavity;

an index finger hole through the second panel;

an index finger pad a webbing positioned between the index finger and a thumb stall;

the index finger hole comprising a channel partially closed by the index finger pad;

a binding defining the channel, wherein the binding does not extend across the channel.

23. A ball glove apparatus comprising:

a first panel;

a second panel attached to the first panel, the first and second panels defining a hand cavity;

an index finger hole formed in the second panel, the index finger hole comprising an index finger channel arranged adjacent the index finger hole, the index finger channel being defined by a binding that traverses up and around the index finger channel, but does not extend across the channel;

the index finger channel further comprising an the index finger pad, which partially closes the index finger channel portion of the index finger hole a webbing positioned between the index finger and a thumb stall;

a plurality of ridges formed on the index finger pad, the ridges extending transversely across the index finger channel, the ridges providing comfort to the user's index finger during use and providing increased control of the glove during use.

24. A glove apparatus according to claim 23 wherein the plurality of ridges are uniformly spaced relative to each other.

25. A glove apparatus according to claim 23 wherein the index finger pad comprises a piece of synthetic material.

26. A glove apparatus according to claim 23 wherein the plurality of ridges comprises 5-15 bumps.

27. A glove apparatus according to claim 23 wherein the plurality of ridges are all external.

28. A glove apparatus according to claim 23, further comprising:

an independent thumb stall;

no thumb loop.

29. A glove apparatus according to claim 23 wherein the second panel comprises an aramid-type material.

30. A glove apparatus according to claim 23, further comprising a plurality of open holes in the second panel.

31. A glove apparatus according to claim 23, further comprising a pattern of holes extending substantially across the entire second panel.

* * * * *